United States Patent [19]

Iwamoto et al.

[11] Patent Number: 4,893,873

[45] Date of Patent: Jan. 16, 1990

[54] SEAT CUSHION ASSEMBLY

[75] Inventors: Hiroaki Iwamoto; Masaaki Kogure, both of Kanagawa, Japan

[73] Assignee: Ikeda Bussan Co., Ltd., Ayase, Japan

[21] Appl. No.: 296,968

[22] Filed: Jan. 13, 1989

[30] Foreign Application Priority Data

Jan. 19, 1988 [JP] Japan ..... 63-4885[U]

[51] Int. Cl.[4] ..... A47C 7/18

[52] U.S. Cl. ..... 297/452; 5/468; 297/453; 297/459; 297/DIG. 1

[58] Field of Search ..... 297/452, 453, 458, 459, 297/460, DIG. 1; 5/448, 468, 481

[56] References Cited

U.S. PATENT DOCUMENTS

| | | | |
|---|---|---|---|
| 3,924,893 | 12/1975 | Ferrara | 297/453 X |
| 4,579,389 | 4/1986 | Shimbori et al. | 297/DIG. 1 |
| 4,609,389 | 4/1986 | Yoshizawa | 297/452 |

FOREIGN PATENT DOCUMENTS

| | | |
|---|---|---|
| 0226165 | 6/1987 | European Pat. Off. . |
| 8511841 | 4/1985 | Fed. Rep. of Germany . |
| 1018951 | 2/1966 | United Kingdom . |
| 1265849 | 3/1972 | United Kingdom . |
| 1411399 | 10/1975 | United Kingdom . |

*Primary Examiner*—Peter R. Brown

*Attorney, Agent, or Firm*—Foley & Lardner, Schwartz, Jeffery, Schwaab, Mack, Blumenthal & Evans

[57] ABSTRACT

Disclosed herein is a seat cushion assembly which comprises a seat frame having opposed side frame portions; a cushion pad including a major part and side parts which are arranged along both sides of the major part, the cushion pad being supported on the seat frame having the side parts thereof respectively supported on the opposed side frame portions; and an outer skin member covering each of the major and side parts of the cushion pad, wherein each side part is connected at only longitudinal both end portions thereof to the major part leaving an intermediate portion thereof separated from the major part.

4 Claims, 1 Drawing Sheet

SEAT CUSHION ASSEMBLY

BACKGROUND OF THE INVENTION

1. Field of the Invention

The present invention relates in general to seats, and more particularly to seat cushion assemblies of a type which generally comprises a major part, side parts arranged at both sides of the major part and a frame structure on which the major and side parts are arranged.

2. Description of the Prior Art

In order to clarify the task of the present invention, one conventional seat cushion assembly of the above-mentioned type will be described with reference to FIG. 4.

The seat cushion assembly 1 shown in the drawing is of a type which comprises a major part 1A which supports almost entire weight of a seated person, side parts 1B which are arranged at both sides of the major part 1A and a frame structure on which the major and side parts 1A and 1B are arranged. Each side part 1B has its longitudinally extending side edge entirely connected or sewed to the side of the major part 1A.

However, due to its inherent construction, the seat cushion assembly 1 has such a drawback that the deflection of the major part 1A caused by a person sitting thereon draws or pulls greatly the side parts 1B downward deforming the same thereby deteriorating the external appearance of the seat. Furthermore, due to the entire connection between the major part 1A and each side part 1B, the major part 1A is prevented from making sufficient deflection upon sitting of a person thereon.

SUMMARY OF THE INVENTION

It is therefore an object of the present invention to provide a seat cushion assembly which is free of the above-mentioned drawbacks.

According to the present invention, there is provided a seat cushion assembly, which comprises a seat frame having opposed side frame portions; a cushion pad including a major part and side parts which are arranged along both sides of the major part, the cushion pad being supported on the seat frame having the side parts thereof respectively supported on the opposed side frame portions; and an outer skin member covering each of the major and side parts of the cushion pad, wherein each side part is connected at only longitudinal both end portions thereof to the major part leaving an intermediate portion thereof separated from the major part.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 3:
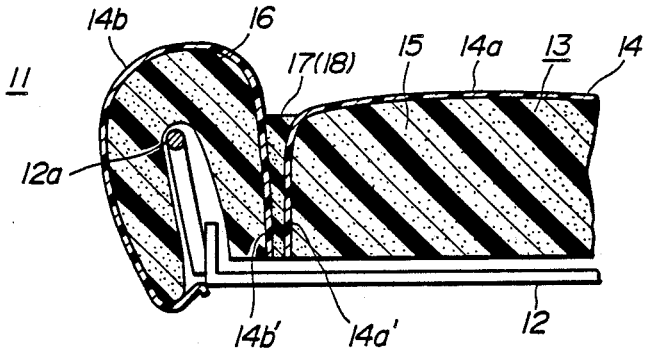
FIG. 3 is a sectional but half view of the seat cushion as of the present invention.
Figure 4:
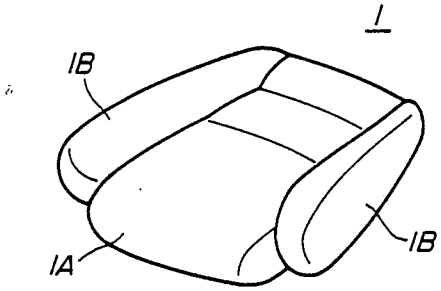
FIG. 4 (PRIOR ART)
FIG. 4 is a perspective view of a conventional seat cushion assembly.

Referring to FIG. 3, there is shown but partially a seat cushion assembly 11 according to the present invention. The seat cushion assembly 11 comprises a generally rectangular seat frame 12 serving as a structural base of the assembly, a cushion pad 13 mounted on the seat frame 12, and an outer skin member 14 covering the cushion pad 13. Designated by numeral **12*a* is a side frame which extends along each side of the seat frame 12. The outer skin member 14** comprises an outer layer and a wadding lined on an inner surface of the outer layer.

As will be seen from FIGS. 1 and 2, the cushion pad 13 comprises a major part 15 and side parts 16 which are connected to the major part 15 in a manner as will be described in the following.

Figure 1:
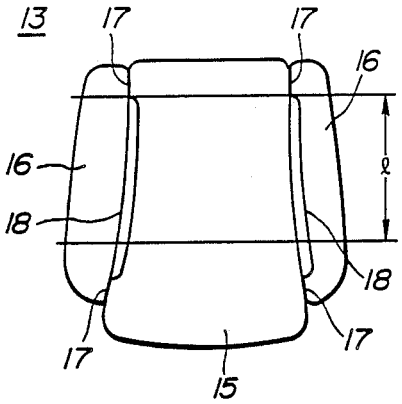
FIG. 1 is a plan view of a cushion pad employed in a seat cushion assembly of the present invention.
Figure 2:
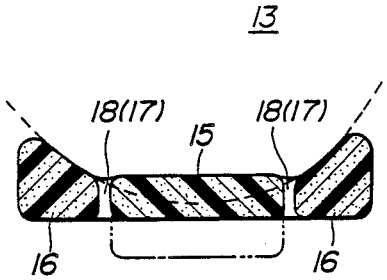
FIG. 2 is a sectional view of the seat cushion pad.

That is, as is best seen from FIG. 1, each side part 16 is connected at only front and rear portions thereof to the major part 15 leaving an intermediate portion thereof separated or disconnected from the major part 15. Numeral 17 denotes the portion where the side part 16 and the major part 15 are integrally connected, while numeral 18 denotes the portion where the side part 16 is separated from the major part 15. Thus, when the cushion pad 13 is of a monolithic member constructed of for example a foamed polyurethane or the like, making two slits at portions corresponding to the portions 18 and 18 produces a desired shape of the cushion pad 13. The length "l" of each slit "18" is determined by considering the flexibility which the pad 13 has.

If desired, a series of short slits may be provided in place of the slit 18.

Referring back to FIG. 3, the side frame **12*a* supports thereon the side part 16 of the cushion pad 13. The outer skin member 14 has a part 14*a* which covers the major part 15 and another part 14*b* which covers the side part 16. The terminal portions 14*a*' and 14*b*' of the respective parts 14*a* and 14*b* are connected to the seat frame 12** by means of clips (not shown).

Because of provision of the separated portion or slit 18 between each side part 16 and the major part 15, the deflection of the major part 15 caused by the sitting of a person thereon does not induce the undesirable deformation of the side parts 16. Furthermore, because of the same reason, the deflection of the major part 15 is appropriately effected without being affected by the side parts 16.

What is claimed is:

1. A seat cushion assembly comprising:

a seat frame having opposed side frame portions;

a foam cushion pad including a major part and longitudinally extending side parts each having two end portions, and which are arranged along both sides of said major part, said cushion pad being directly mounted on said seat frame having said side parts thereof respectively directly mounted on said opposed side frame portions; and an outer skin member covering each of said major and side parts of said cushion pad, wherein each side part is connected only at both end portions thereof to said major part leaving an intermediate portion thereof separated from said major part.

2. A seat cushion assembly as claimed in claim 1, in which said intermediate portion of the side part extends along a longitudinally extending side portion of said major part to which almost entire weight of a seated occupant is likely to be applied.

3. A seat cushion assembly as claimed in claim 2, in which said end portions of each side part are integral with said major part.

4. A seat cushion assembly as claimed in claim 3, in which said cushion pad is constructed of a foamed polyurethane.

* * * * *